US005726695A

United States Patent [19]

Ueda

[11] Patent Number: 5,726,695

[45] Date of Patent: Mar. 10, 1998

[54] DEVELOPING DEVICE

[75] Inventor: Atsushi Ueda, Shiki-gun, Japan

[73] Assignee: Sharp Kabushiki Kaisha, Osaka, Japan

[21] Appl. No.: 534,280

[22] Filed: Sep. 27, 1995

[30] Foreign Application Priority Data

Oct. 31, 1994 [JP] Japan ..... 6-267263

[51] Int. Cl.[6] ..... B41J 2/06; B41J 2/165

[52] U.S. Cl. ..... 347/55; 347/34

[58] Field of Search ..... 347/55, 112, 141, 347/34

[56] References Cited

U.S. PATENT DOCUMENTS

| | | | |
|---|---|---|---|
| 4,218,691 | 8/1980 | Fujii | 347/55 |
| 4,948,692 | 8/1990 | Higashimura et al. | 430/106.6 |
| 5,233,392 | 8/1993 | Kitamura . | |
| 5,359,361 | 10/1994 | Iwao et al. | 347/55 |
| 5,386,225 | 1/1995 | Shibata | 347/55 |
| 5,572,309 | 11/1996 | Nishio et al. | 399/389 |
| 5,606,397 | 2/1997 | Honda et al. | 399/98 |
| 5,606,402 | 2/1997 | Fujita et al. | 399/222 |

FOREIGN PATENT DOCUMENTS

| | | |
|---|---|---|
| 3206780A1 | 12/1982 | Germany . |
| 57108871 | 7/1982 | Japan . |
| 58-044457 | 3/1983 | Japan . |
| 58-114974 | 7/1983 | Japan . |
| 1503221 | 11/1989 | Japan . |
| 3168767 | 7/1991 | Japan . |
| 3211064 | 9/1991 | Japan . |
| 2070981A | 9/1981 | United Kingdom . |

*Primary Examiner*—Peter S. Wong
*Assistant Examiner*—Gregory J. Toatley, Jr.
*Attorney, Agent, or Firm*—David G. Conlin; John L. Welch

[57] ABSTRACT

A developing device has a brush-like toner carrying roller for carrying charged toner and a toner supply roller which is in contact with the toner carrying roller and charges the toner by friction, and applies a voltage having the same polarity as the charging polarity of the toner to the toner supply roller. With this arrangement, since the charged toner and the toner supply roller produce repulsion therebetween, it is possible to carry a sufficient amount of toner on the surface of the toner carrying roller. Therefore, even when the electric field strength is weak, it is possible to cause a sufficient amount of toner to fly from the surface of the toner carrying roller. Consequently, a quality image can be stably produced with an inexpensive small-size structure. Moreover, by moving the toner carrying roller to a position where it comes into contact with a grid electrode and cleaning the grid electrode with the rotating toner carrying roller, it is possible to prevent a lowering of the image quality due to adhesion of the toner to the grid electrode.

23 Claims, 4 Drawing Sheets

DEVELOPING DEVICE

FIELD OF THE INVENTION

The present invention relates to a developing device for use in an image forming apparatus for printing image data (for example, characters and drawings) output by a computer, word processor, facsimile machine, etc., on a recording medium such as a sheet.

BACKGROUND OF THE INVENTION

An electrophotographic method is widely used as a method for forming image data as a visible image on a recording medium such as a sheet. In this method, first, a photoconducting surface of a photoreceptor is uniformly charged. Meanwhile, the image data of a document is converted into image information carrying light by a semiconductor laser device, an LED head and so on. Then, the light is applied to the photoreceptor which has been uniformly charged. As a result, the charge on the photoreceptor surface is attenuated according to the intensity of the applied light, and an electrostatic latent image is formed. The electrostatic latent image is visualized by bringing charged toner into contact with the electrostatic latent image or causing the toner to fly to the electrostatic latent image, thereby forming a toner image. The toner image is electrostatically transferred to a sheet, and fixed on the sheet using heat and pressure so as to complete an imaging process on the sheet.

With a device employing the above-mentioned electrophotographic method, a high-quality image can be obtained. However, in this device, after temporarily forming a electrostatic latent image and a toner image on the photoreceptor as an intermediate recording medium, it is necessary to transfer the toner image to a sheet, requiring a large number of steps for imaging. Therefore, it takes a long time to perform imaging, and the size of the image forming apparatus is increased because a large number of devices including the intermediate recording medium are required.

In order to solve such problems, recently, Japanese Publication for PCT Application No. 503221/1989 (Tokuhyohei 1-503221) proposes a method in which matrix electrodes capable of selectively applying a voltage to a development section are disposed and a toner image is directly formed on a sheet by causing toner to fly according to image data with an electric field which is generated by an application of a voltage corresponding to the image data to the matrix electrodes. In this case, in order to control the direction and width of flying toner, a control grid is disposed in the developing section.

In this method, the toner is carried on the surface of a toner carrying roller, and supplied to the development section with a rotation of the toner carrying roller. Various publications disclose methods for supplying toner to the developing device. Japanese Publication for Unexamined Patent Application No. 44457/1983 (Tokukaisho 58-44457) discloses a method in which an alternating electric field is applied to a section between the toner carrying roller and the control grid, and toner is transported in a cloud state. Japanese Publication for Unexamined Patent Application No. 114974/1983 (Tokukaisho 58-114974) discloses a method for transporting toner with the flow of air.

Additionally, Japanese Publication for Unexamined Patent Application No. 168767/1991 (Tokukaihei 3-168767) proposes a technique for dropping toner onto a sheet passing through a back electrode by giving mechanical vibrations to the toner with an application of a variable voltage to a control grid at the time imaging is not performed, and a technique for bringing the toner back to the toner carrying roller by applying to the control grid a voltage of the same polarity as that of the charging potential of the toner and generating an electric field whose direction is opposite to that generated during imaging in a section between the control grid and the toner carrying roller.

However, the above-mentioned conventional techniques suffer from the following drawbacks.

When the method of Japanese Publication for PCT Application No. 503221/1989 is used as a method for transporting toner to the toner development section, since the adhesive force (magnetic force) of the toner to the toner carrying roller is large, a strong electric field is required for moving the toner to a sheet. Consequently, it is necessary to use a large-scale high-voltage power source for applying an extremely high voltage, increasing the size of the device and cost.

In addition, the method of Japanese Publication for Unexamined Patent Application No. 44457/1983 suffers from such problems that the necessity of a large-scale high-voltage power source for the alternating electric field increases the cost, and the image becomes unclear because the alternating electric field distorts a signal electric field for facilitating the passage of toner through the control grid.

The method of Japanese Publication for Unexamined Patent Application No. 114974/1983 presents a problem that it is necessary to use an expensive device such as a compressor.

Since all of the above-mentioned methods use a structure in which a dot pattern corresponding to image information is formed on a sheet while causing the toner to pass through a toner passage opening (gate) of the control grid, and the control grid and the area surrounding the toner passage opening are coated with an insulating layer. Therefore, the toner electrostatically adheres to the control grid due to friction generated between the toner and the respective sections. Such adhering toner prevents a smooth passage of toner for development, and distorts the dot pattern formed on the sheet.

SUMMARY OF THE INVENTION

It is an object of the present invention to provide a developing device capable of continuously transporting a sufficient amount of toner and stably forming a quality image with an inexpensive small-size structure. It is another object of the present invention to provide a developing device capable of preventing a lowering of the image quality due to adhesion of toner by cleaning the toner adhering to a grid electrode (control grid).

In order to achieve the above objects, a developing device of the present invention includes:

- a brush-like toner carrying roller for carrying charged toner, the toner carrying roller having an electric potential equal to a charging potential of the toner or being connected to an earth potential;
- a toner supply roller, disposed in contact with the toner carrying roller, for charging the toner by friction;
- a back electrode, disposed to face the toner carrying roller, for causing the toner carried on the toner carrying roller to fly by forming an electric field;
- a grid electrode having a plurality of gates for allowing a passage of the flying toner, and controlling means for controlling an amount of the toner passing through the gates by applying a varying voltage to the gates according to image data to be formed, the grid electrode being disposed between the toner carrying roller and the back electrode; and voltage applying means for applying a voltage having the same polarity as the charging polarity of the toner to the toner supply roller.

Imaging using the developing device of the above-mentioned structure is performed as follows. First, the toner is charged to a predetermined potential by friction using the toner supply roller. The charged toner flies from the toner carrying roller toward the back electrode due to an electric field formed by the back electrode. At this time, a varying voltage according to the image data to be formed is applied to the grid electrode disposed between the toner carrying roller and the back electrode under control by the controlling means. This influences the flying of toner, and thus the amount of the flying toner varies depending on the image data at each gate of the grid electrode. Namely, the controlling means controls the amount of toner passing through each gate to vary according to the image data to be formed. Consequently, by transporting a recording medium to a section between the grid electrode and the back electrode, the flying toner adheres to the recording medium and a toner image is formed on the recording medium.

With this structure, since the toner carrying roller has a brush-like shape and since the surface carrying the toner has an increased area, it is possible to carry an increased amount of toner on the roller surface.

Moreover, since the toner supply roller is disposed to come into contact with the toner carrying roller, it is possible to sufficiently charge the toner by friction with a rubbing action between the toner carrying roller and the toner supply roller. As a result, a sufficient amount of toner can be always supplied to the toner carrying roller.

Furthermore, since the voltage having the same polarity as the charging polarity of the toner is applied to the toner supply roller by the voltage applying means, the sufficiently charged toner produces repulsion against the toner supply roller and moves in a direction escaping from the toner supply roller. Namely, in an area of the surface of the toner carrying roller which is being separated from the toner supply roller by its own rotation, since the toner is pressed against the surface of the toner carrying roller, it is possible to carry a sufficient amount of toner on the surface of the toner carrying roller.

As described above, by forming the toner carrying roller into a brush-like shape, disposing the toner supply roller to come into contact with the toner carrying roller and applying the voltage having the same polarity of the charging polarity of the toner to the toner supply roller, it is possible to carry a sufficient amount of toner on the surface of the toner carrying roller. As a result, the sufficient amount of toner can continue to be transported to the recording medium and a toner image is stably formed without variations in the image density. In addition, since this structure prevents the toner from flying disorderly, it is possible to form quality toner images. Moreover, even if the force for flying the toner from the toner carrying roller toward the back electrode is small, it is possible to cause a sufficient among of toner to fly. With this arrangement, since the applied voltage to the back electrode can be set low, a high-voltage source is not required, thereby achieving an inexpensive small-size structure. This arrangement also prevents variations in the density of the toner image, particularly, a lowering of the density in the latter half of the toner image when forming a high-density toner image, thereby forming a quality toner image.

A part of the surface of the toner carrying roller comes closer to the toner supply roller with a rotation of the toner carrying roller after causing the toner to fly in a pattern corresponding to the image data in the development section. At this time, although residual toner (image memory) remains on the surface of the toner carrying roller, the residual toner is removed from the surface of the toner carrying roller by repulsion against the toner supply roller because the voltage having the same polarity as the charging polarity of the toner is applied to the toner supply roller. Then, the above-mentioned part of the surface of the toner carrying roller is separated from the toner supply roller and faces the development section. Since the residual toner (image memory) of the previous toner image is removed after development, a quality toner image can be formed.

With this structure, it is desirable that the toner carrying roller is rotated in a forward direction with respect to the transport direction of the recording medium. Furthermore, the rotation speed of the toner carrying roller is preferably set so that the moving speed of the surface of the toner carrying roller is higher than the moving speed of the recording medium. With these settings, since the area of the surface of the toner tarrying roller which faces the recording medium is increased, it is possible to efficiently transport the toner carried on the surface of the toner carrying roller to the recording medium. Consequently, it is possible to cause a sufficient amount of toner to fly without increasing the applied voltage to the back electrode. As a result, the sufficient amount of toner can continue to be transported and a quality image can be formed in a stable manner with an inexpensive small-size structure.

Moreover, with this structure, non-magnetic toner is preferably used. With the use of the non-magnetic toner, since magnetic powder can never adhere to a sheet during imaging, it is possible to form a quality image with clear color.

It is desirable that this structure further includes moving means for moving the toner carrying roller to a position where the toner carrying roller comes into contact with the grid electrode and that the grid electrode is cleaned with the rotating toner carrying roller.

With this arrangement, the toner carrying roller is moved to come into contact with the grid electrode by the moving means, and rotated. When the brush section of the toner carrying roller rubs on the surface of the grid electrode, the toner adhering to the surface of the grid electrode is cleaned. It is therefore not necessary to additionally provide a member for cleaning the grid electrode. Consequently, the number of parts is reduced, and an inexpensive small-size structure is achieved. Furthermore, since the toner adhering to the grid electrode can be cleaned, it is possible to prevent an image from having a blank portion due to the adhering toner, thereby forming a quality toner image.

For a fuller understanding of the nature and advantages of the invention, reference should be made to the ensuing detailed description taken in conjunction with the accompanying drawings.

DESCRIPTION OF PREFERRED EMBODIMENTS

Figure 1:
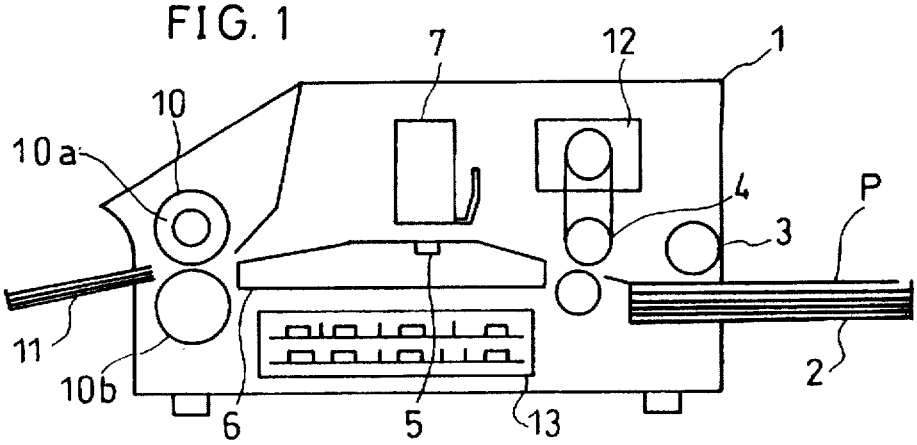
FIG. 1 is a view schematically showing the structure of an image forming apparatus including a developing device of the present invention.

The following description will discuss one embodiment of the present invention with reference to the accompanying drawings. FIG. 1 schematically shows the structure of an image forming apparatus including a developing device of the present invention.

The image forming apparatus of this embodiment is connected to external devices such as a computer, word processor and facsimile machine, not shown, and receives image data and an imaging start signal from these external devices.

The structure of the image forming apparatus will be explained below.

Installed on the right side of the main body 1 of the image forming apparatus is a paper cassette 2 for storing a plurality of sheets P as recording media of images. A feed roller 3 is mounted above an end section of the paper cassette 2, and feeds the sheets P in the paper cassette 2 piece by piece from the topmost sheet. The sheet P fed by the feed roller 3 is transported on a transport guide plate 6 by transport rollers 4. A back electrode 5 is mounted on a central section of the top surface of the transport guide plate 6. A developing device 7 is disposed above the back electrode 5 to face the back electrode 5, and forms a toner image on the sheet P passing through a section between the developing device 7 and the back electrode 5.

Figure 2:
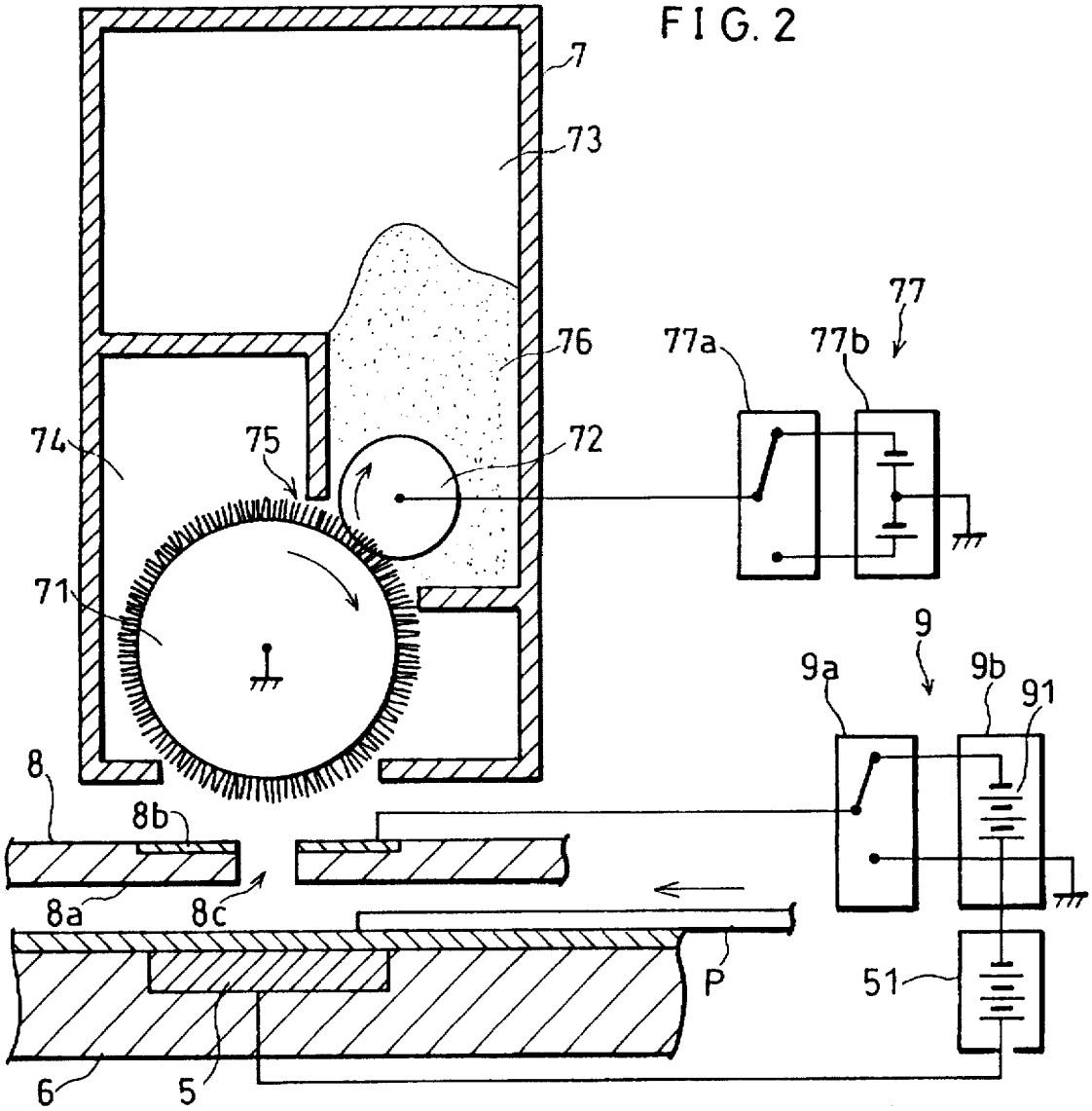
FIG. 2 is a cross section showing the structure of a developing device according to one embodiment of the present invention.
Figure 3:
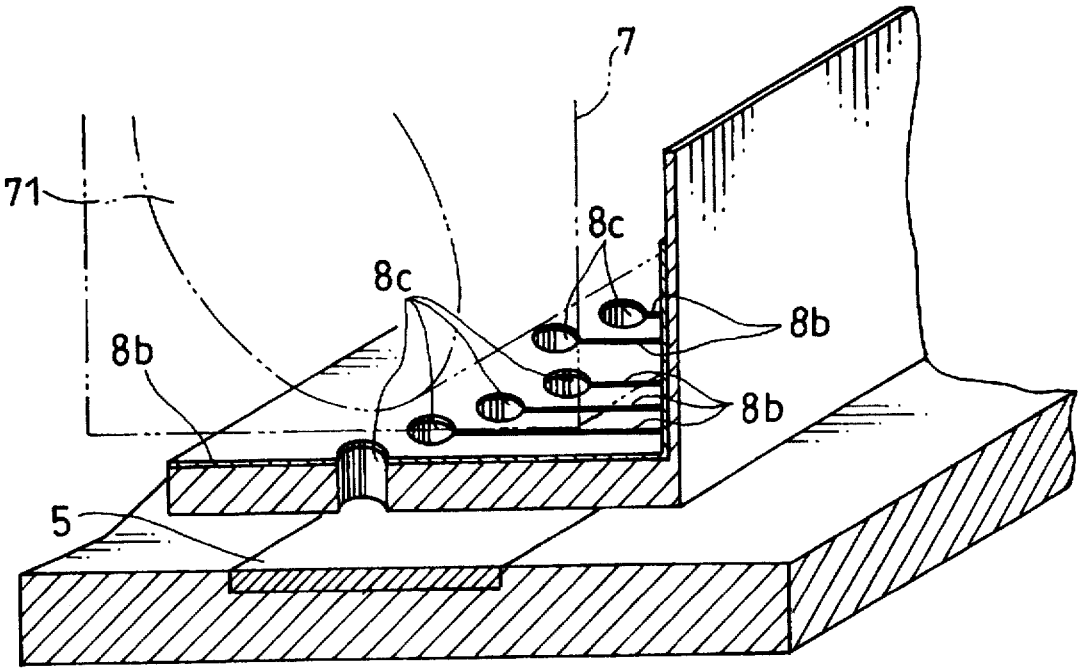
FIG. 3 is a perspective view showing the vicinity of a development section of the developing device.

FIG. 2 illustrates one example of the structure of the developing device 7. FIG. 3 is a perspective view showing the vicinity of a development section of the developing device 7. The developing device 7 includes a toner room 73 for storing toner 76, and a development room 74 facing the back electrode 5. A toner supply opening 75 is formed between the toner room 73 and the development room 74. Disposed at the opening 75 is a toner supply roller 72 for supplying the toner 76 to a toner carrying roller 71 in the development room 74. An opening section is formed on a side of the development room 74 which faces the back electrode 5, and the toner carrying roller 71 is positioned so that a part of its surface is located in the opening section.

The toner carrying roller 71 has a toner carrying section (brush section) which surrounds a roller-shaped core member made of conducting metal. The toner carrying section is formed by a conducting brush-like member. For example, the toner carrying section is formed by implanting conducting fibers into a conducting sheet-type material, a cloth having fuzzy conducting fibers on a surface of a conducting sheet-type material, or a conducting resin. When using the sheet material having the implanted conducting fibers or the cloth having the conducting fuzzy fibers, the toner carrying roller 71 is constructed by attaching the sheet material or the cloth on the metal core. When using the conducting resin, the toner carrying roller 71 is constructed by coating the surface of the metal core with an uneven film of the resin.

The conducting resin is formed by mixing a conducting substance into a synthetic resin so that it is thoroughly dispersed. The conducting fibers are fibers made of the conducting resin.

Examples of the synthetic resin are polyolefine resins such as polyethylene, polypropylene and polymethyl pentene, fluoroplastics such as polychlorotrifluoroethylene, polyester resins such as polyethylene terephthalate and polybutylene terephthalate, and cellulose resins such as rayon. As to the conducting material which imparts electrical conductivity to the synthetic resin, it is possible to use carbon black such as acetylene black, and fine particles of, for example, stannic oxide (IV), indium oxide and potassium titanate.

In a specific example of the structure of the toner carrying roller 71, conducting rayon fibers with an resistivity of $10^8$ Ω·cm and a thickness of 20 μm formed by, for example, mixing the rayon fibers into carbon black, are used. The toner carrying roller 71 is constructed by implanting 6000 conducting rayon fibers per $cm^2$ of the sheet material and arranging the length of the brush to be substantially 0.5 mm.

In this image forming apparatus, the amount of toner which adheres to the surface of the toner carrying roller 71 and is transported to the development section (a location at which the back electrode 5 and a grid electrode 8 face the toner carrying roller 71) needs to be sufficient for forming an image.

As described above, in the structure of the present invention, since the toner carrying roller 71 has a brush-like shape, it is possible to cause a large amount of toner 76 to adhere to the brush section. Namely, since the toner carrying roller 71 three-dimensionally carries the toner 76 on the surface section (toner carrying section) in the shape of a brush, the surface to which the toner 76 adheres becomes larger in a direction orthogonal to the roller axis. Therefore, even when the density of the toner 76 adhering to the surface of the toner carrying roller 71 is low, it is possible to carry a sufficient amount of the toner 76 for imaging. Here, the adhesive force of the toner 76 to the surface of the toner carrying roller 71 is represented by the sum of the toner image force and the adhesive force between toner particles. Even when the toner density on the surface of the toner carrying roller 71 is sparse, if the sufficient amount of toner 76 is carried, an adhesive force between toner particles among the adhesive forces of the toner 76 to the toner carrying roller 71 is reduced, and substantially only the toner image force is present, thereby decreasing the adhesive forces of the toner 76 to the toner carrying roller 71. As a result, the toner 76 tends to fly from the surface of the toner carrying roller 71, the force for causing the toner 76 to fly toward the back electrode 5 becomes smaller.

It is thus possible to apply a smaller voltage to the back electrode 5. With this structure, since a high voltage is not required, it is possible to decrease the cost and achieve safety.

The toner carrying roller 71 is supported so that it is freely rotatable in the forward direction in the transport direction of the sheets P. The peripheral velocity of the toner carrying roller 71 is set slightly higher than the transport speed of the sheets P. The metal core of the toner carrying roller 71 is grounded or connected to a power source having a potential similar to the charging potential of the toner 76.

The toner supply roller 72 is a conducting resilient roller including a core member made of a conducting metal roller and a conducting resilient member surrounding the core member. In particular, an urethane resin foam covered with a conducting urethane rubber is preferable as the resilient member. The resistivity of the toner supply roller 72 is set lower than the resistivity of the toner carrying roller 71. For example, it is set around $10^8$ Ω·cm. The rotation direction of the toner supply roller 72 is equal to the rotation direction of the toner carrying roller 71 as shown in FIG. 2. The peripheral velocity of the toner supply roller 72 is set slightly higher than that of the toner carrying roller 71.

The toner supply roller 72 is connected to the power source section 77. The power source section 77 includes a switching circuit (polarization switching means) 77*a* and a voltage generating section (voltage applying means) 77*b*, and selectively applies a voltage with positive polarity or negative polarity to the toner supply roller 72. In this embodiment, the toner 76 has a negative charge, and a negative voltage (the same polarity as the charging voltage of the toner 76) is applied to the toner supply roller 72 during development, while a positive voltage (the opposite polarity to the charging voltage of the toner 76) is applied to the toner supply roller 72 in cleaning the grid electrode 8.

The toner 76 stored in the toner room 73 is a one-component toner of a non-magnetic type, and formed with a diameter of 5 to 20 μm by dispersing pigment such as carbon and a polar control agent such as metal containing azo dye into a thermoplastic resin such as a polystyrene resin and acrylic resin and by grinding and classifying the resulting material. The toner 76 is charged by friction in an agitating action performed by the rotation of the toner supply roller 72 and the toner carrying roller 71. The charging polarity of the toner 76 may be changed to positive by selecting different materials.

As described above, since the non-magnetic toner containing no magnetic powder is used, the magnetic powder can never adhere to the sheet P during imaging, thereby preventing the resulting image from having blank and turbid portions. Since magnetic toner contains magnetic powder for carrying toner particles. Consequently, when the magnetic toner is used, the magnetic powder is mixed into the image. This causes turbid colors and an extremely ugly image especially when forming a color image.

On the other hand, in this embodiment, since the toner 76 containing no magnetic powder is used, the above-mentioned problem can never occur, and therefore the resulting image has satisfactory quality. Namely, a clear color image without turbid colors is obtained. In order to increase the adhesive force of the toner 76 to the brush-like toner carrying roller 71, it is possible to add an additive such as a charge control agent.

Figure 4:
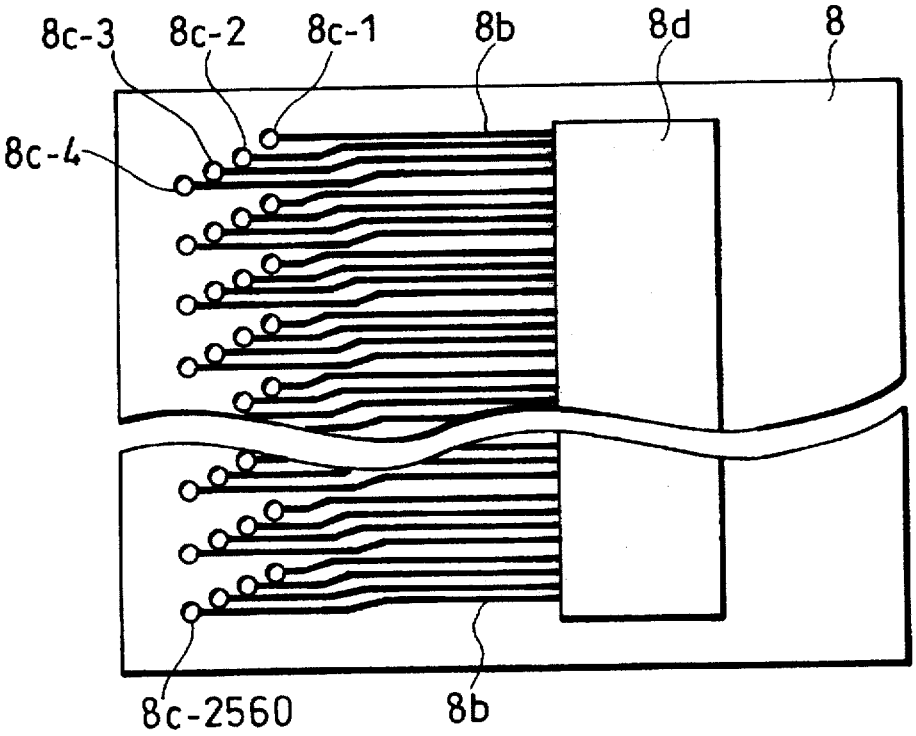
FIG. 4 is a plan view showing the structure of a grid electrode.

The grid electrode 8 is disposed between the developing device 7 and the transport guide plate 6. The grid electrode 8 includes a control substrate 8*a* having a control circuit, and a plurality of control electrodes 8*b* and gates 8*c* on the control substrate 8*a*. FIG. 4 is a plan view showing the structure of the grid electrode 8.

The control substrate 8*a* includes a plurality of gates 8*c*-1, 8*c*-2, . . . . 8*c*-2560 in the shape of circular holes. Namely, in this embodiment, the grid electrode 8 includes 2560 gates 8*c* in the shape of circular holes. The number of gates 8*c* is suitably arranged according to the size (imaging width) of the image forming apparatus and the resolution of an image to be formed. The gates 8*c* are disposed so that each group of the gates 8*c* is aligned diagonally with respect to the axis direction of the toner carrying roller 71. As a result, adjacent gates 8*c* (for example, 8*c*-1 and 8*c*-2) can never overlap each other. As illustrated in FIG. 2, the control electrode 8*b* is disposed in the periphery of each of the gates 8*c*-1, 8*c*-2, . . . . . The control electrodes 8*b* are connected to a driver IC 8*d* for applying a voltage to the control electrodes 8*b*. The control electrodes 8*b* and the driver IC 8*d* form controlling means. The driver IC 8*d* includes a serial-to-parallel converter for converting an image data signal input as a serial signal into a predetermined number of parallel signals, and a voltage converter for converting the voltage of the parallel signals into a predetermined voltage. Namely, after converting the image data signal into the parallel signals corresponding to the number of the control electrodes 8*b*, i.e., the number of the gates 8*c*, and converting the parallel signals into a predetermined voltage level, the driver IC 8*d* applies the voltage to the corresponding control electrodes 8*b*. With this process, different voltages are applied to the gates 8*c*-1, 8*c*-2, . . . . . respectively, and the amount of toner 76 passing each gate 8*c* is individually controlled. The control electrodes 8*b* of the grid electrode 8 are connected to a power source section 9 through the driver IC 8*d*.

As illustrated in FIG. 2, the power source section 9 includes a switching circuit 9*a* and a power source switching section 9*b*, and selectively connects the control electrodes 8*b* to a negative potential (the same polarity as the charging voltage of the toner 76) or an earth potential through the driver IC 8*d*. More specifically, the control electrodes 8*b* are connected to a negative power source 91 during a normal imaging process. The negative power source 91 has a voltage conversion capability, and switches the voltage value according to the image data to be formed. The control electrodes 8*b* are connected to the earth potential when forming a dot. The control electrodes 8*b* are connected to a negative potential (the same polarity as the charging voltage of the toner 76) during cleaning.

The back electrode 5 is disposed in the transport guide plate 6 along the axis direction of the toner carrying roller 71. The back electrode 5 is connected to a positive power source 51 (the opposite polarity to the charging voltage of the toner 76), and the toner 76 on the toner carrying roller 71 is attracted by the back electrode 5 and flies. The sheet P fed from the paper cassette 2 is transported in the direction of an arrow shown in FIG. 2, and passes through a section between the grid electrode 8 and the back electrode 5. When the sheet P passes through the section between the grid electrode 8 and the back electrode 5, an amount of the toner 76 adheres to the sheet P in a shape corresponding to the image data, thereby forming a toner image on the sheet P.

Figure 6:
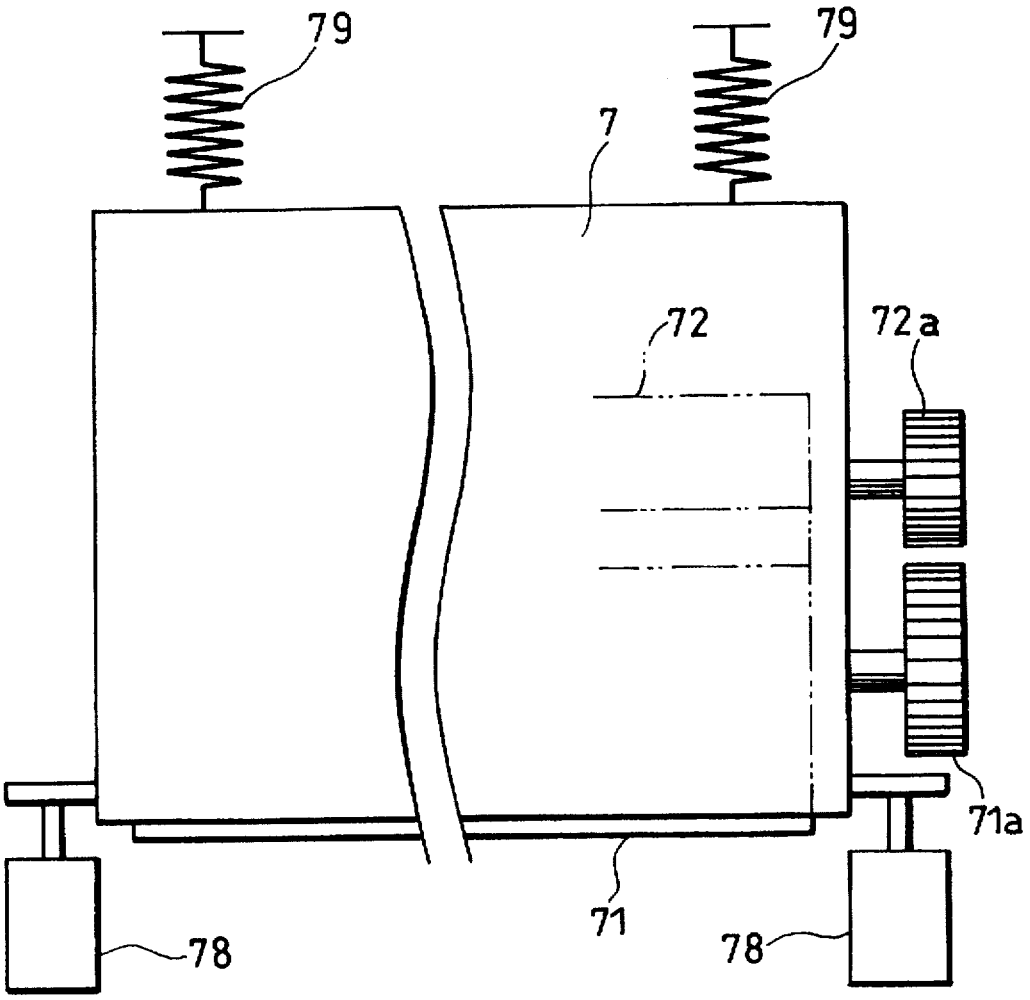
FIG. 6 is an explanatory view showing essential sections of a moving mechanism of the developing device.

In the above-mentioned structure, the entire body of the developing device 7 is movable in upward and downward directions. As illustrated in FIG. 6, a solenoid 78 is mounted on both sides of the developing device 7 facing the toner carrying roller 71, and extension springs 79 for pulling up the developing device 7 is mounted on the upper section thereof. In this case, the solenoids 78 and the extension springs 79 form moving means. When the solenoids 78 are turned off, the developing device 7 is pulled up by the tensile forces of the springs 79 to the position shown in FIG. 2, i.e., the imaging position. On the other hand, when the solenoids 78 are turned on, the developing device 7 is pulled down against the tensile forces of the springs 79, and moved to a position where the toner carrying roller 71 in the developing device 7 comes into contact with the grid electrode 8.

When the developing device 7 is moved by switching on or off the solenoids 78, a gear 71*a* of the toner carrying roller 71 in the developing device 7 is rotated by coupling with a universal joint (not shown) on the main body 1 of the image forming apparatus. Thus, with a rotational movement of the toner carrying roller 71, it comes into contact with the grid electrode 8 and cleans the grid electrode 8.

In this embodiment, the entire body of the developing device 7 is movable. However, it is also possible to arrange only the toner carrying roller 71 to move in the upward and downward directions. In this case, it is necessary to provide a toner shutdown section so as to prevent a leakage of the toner 76 from the developing device 7.

Finally, in the structure of this embodiment, as illustrated in FIG. 1, an output tray 11 for the discharge of a sheet having an image formed thereon is installed on the left side of the main body 1 of the image forming apparatus, and a fixing device 10 is disposed between the output tray 11 and the transport guide plate 6. The fixing device 10 is formed by a heating roller 10*a* and a pressure roller 10*b*. In the heating roller 10*a*, a heating source including a halogen lamp heats the surface of the heating roller 10*a* to a toner fixing temperature (around 180° C.). The pressure roller 10*b* is pressed against the heating roller 10*a*. An image formed by the toner on the sheet P is fused by the heating roller 10*a* and the pressure roller 10*b*.

Disposed in the main body 1 of the image forming apparatus are a motor 12 for supplying a rotative force to a rotating system including the feed roller 3 and the transport rollers 4, and a control unit 13 incorporating a control circuit which controls the main body 1. The control unit 13 includes an interface section, an engine control section, and an image signal processing section.

Figure 5:
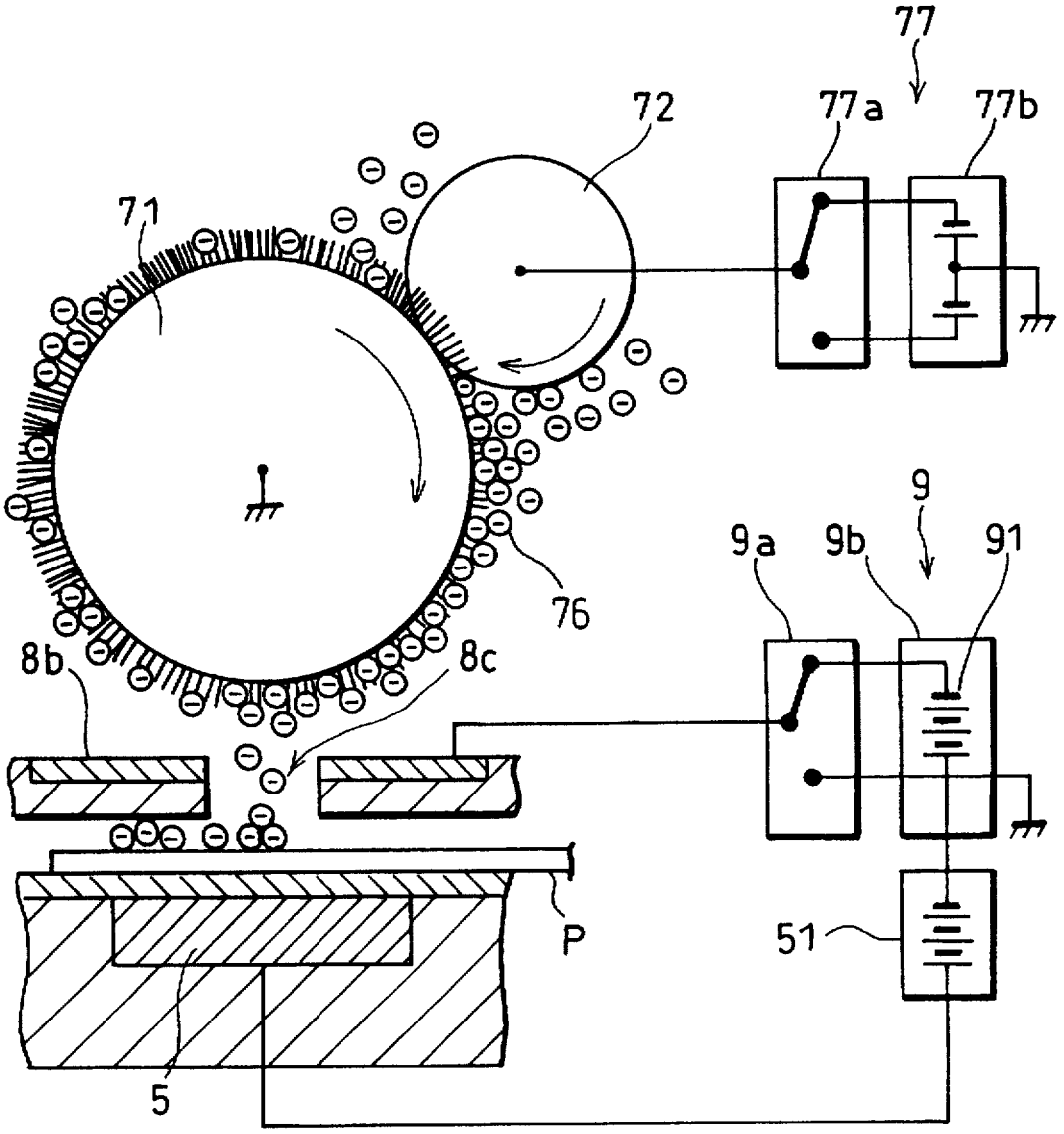
FIG. 5 is an explanatory view showing an operation for forming an image using the developing device.

An operation of the image forming apparatus with the above-mentioned structure will be explained below. External devices such as a computer, word processor and facsimile machine (not shown) output signals including image data and an imaging start signal when forming an image. The interface section installed in the control unit 13 in the main body 1 receives the signals. The interface section detects the imaging start signal among the signals, and sends the signal to the engine control section. The operational procedure in the image forming apparatus was programmed in advance in the engine control section, and imaging operations are sequentially carried out according to the program. Referring now to FIG. 5, the following description discusses the imaging operations.

First, a motor (not shown) in the developing device 7 is rotated to rotate the toner carrying roller 71 and the toner supply roller 72 so as to charge the toner 76 to a predetermined polarity. The toner 76 is agitated with the rotations of the rollers 71 and 72, and charged to a predetermined polarity by friction against the rollers 71 and 72.

The sufficiently charged toner 76 is supplied to the toner carrying roller 71 by the toner supply roller 72. The toner supply roller 72 is connected to a power source (negative power source) having the same polarity as the charging polarity of the toner 76. The toner 76 moves to the toner carrying roller 71 by repulsion between the frictionally charged toner 76 and the toner supply roller 72. With the movement of the toner 76, large amounts of the toner 76 adheres to a portion of the toner carrying roller 71, which is being separated from the toner supply roller 72. As a result, the toner carrying roller 71 faces the development section (the facing sections of the grid electrode 8 and the back electrode 5) while carrying a sufficient amount of the toner 76.

As shown by the arrow in FIG. 2, the rotation direction of the toner supply roller 72 is equal to the rotation direction of the toner carrying roller 71. The peripheral velocity of the toner supply roller 72 is set slightly higher than that of the toner carrying roller 71. With this arrangement, since a larger area of the toner supply roller 72 can come closer to the toner carrying roller 71, the toner 76 is efficiently supplied to the surface of the toner carrying roller 71. It is thus possible to cause a sufficient amount of the toner 76 to fly without increasing the applied voltage to the back electrode 5. Consequently, a sufficient amount of the toner 76 continues to be transported and a quality image is stably formed with an inexpensive small-size structure.

Meanwhile, the feed roller 3 and the transport rollers 4 are rotated with a rotation of the motor 12 in the main body 1 of the image forming apparatus, and the sheet P in the paper cassette 2 is fed and transported to the development section. The sheet P passes through the section between the grid electrode 8 and the back electrode 5. At this time, an image is formed by the toner 76 flown from the toner carrying roller 71. The following description will discusses the operations during imaging.

As described above, the back electrode 5 is connected to the positive power source 51. Therefore, the toner 76 on the toner carrying roller 71 is attracted to the back electrode 5 and flies from the surface of the toner carrying roller 71. In this case, since the peripheral velocity of the toner carrying roller 71 is set higher than the transport speed of the sheet P, even if the applied voltage to the back electrode 5 is relatively low, a sufficient amount of the toner 76 flies toward the back electrode 5. Thus, even if the adhesive force of the toner 76 to the toner carrying roller 71 is relatively strong, it is possible to cause a sufficient amount of the toner 76 to fly. Consequently, even when forming a high-density image, it is possible to form an image with a sufficient density by preventing a lowering of the density in the latter half of the image.

The control electrodes 8*b* of the grid electrode 8 are connected to the negative power source 91 through the driver IC 8*d*. As described above, the control electrode 8*b* is provided for each of the gates 8*c*-1, 8*c*-2 . . . . , and a negative voltage whose value varies according to the image data is applied to the respective control electrodes 8*b*. When the negative voltage is applied to the control electrodes 8*b*, an electric field laying from the toner carrying roller 71 to the back electrode 5 is cancelled out by the control electrodes 8*b*, the flying of the toner 76 is restrained, and the toner 76 receives repulsion from the control electrodes 8*b* and remains on the toner carrying roller 71. As described above, since the voltage whose value varies according to the image data is applied to each control electrode 8*b*, the amount of flying toner 76 differs in each control electrode 8*b*, i.e., in each gate 8*c*. The flying toner 76 adheres to the transported sheet P, and thus the image is formed on the sheet P. The sheet P is further transported to the fixing device 10 where the toner 76 is fixed, and discharged from the main body 1 of the image forming apparatus.

When the toner carrying roller 71 passes through the development section, the toner 76 on the surface thereof adheres to the sheet P in a pattern corresponding to the image data. Therefore, residual toner (image memory) remains in the pattern corresponding to the image on the surface of the toner carrying roller 71 after passing through the development section. After the toner carrying roller 71 on which the image memory remains passes through the development section, it again faces the toner supply roller 72.

As described above, the toner supply roller 72 is connected to the power source having the same polarity as the toner 76. When the toner carrying roller 71 comes closer to the toner supply roller 72, the toner 76 on the surface of the toner carrying roller 71 receives repulsion from the toner supply roller 72. As a result, an amount of the toner 76 corresponding to the image memory is removed from the surface of the toner carrying roller 71. Thereafter, the toner carrying roller 71 faces the toner supply roller 72, and receives a sufficient amount of the toner 76 when it is separated from the toner supply roller 72.

Thus, the amount of the toner 76 on the surface of the toner carrying roller 71 becomes sufficient at the position where the toner carrying roller 71 is separated from the toner supply roller 72. When the toner carrying roller 71 faces the development section and development is carried out, it holds residual toner (image memory). Then, when the toner carrying roller 71 comes closer to the toner supply roller 72, an amount of the toner 76 corresponding to the image memory is removed. Thereafter, the amount of the toner 76 becomes sufficient again at the position where the toner carrying roller 71 is separated from the toner supply roller 72.

Namely, the toner carrying roller 71 has a supply of a sufficient amount of the toner 76 and a removal of an amount of the toner 76 corresponding to the image memory in one rotation by the function of the toner supply roller 72. Therefore, in the next rotation, development can be carried out without being influenced by the image memory of the previous rotation while carrying a sufficient amount of the toner 76. It is thus possible to always form a quality image with stability.

Next, the cleaning of the grid electrode 8 will be discussed. The cleaning of the grid electrode 8 is periodically carried out, for example, during a warm-up period immediately after turning on the main body 1, or every time a predetermined time has elapsed or imaging has performed on a predetermined number of sheets when the power source of the main body 1 is in the ON state. In the latter two cases, i.e., the execution of cleaning when the power source of the main body 1 is in the ON state, cleaning can never be carried out at the time which may influence the imaging process even if a predetermined time has elapsed or imaging has been performed on a predetermined number of sheets. Therefore, for example, when a sequence of imaging processes are in progress, cleaning is carried out at the time the sequence of the processes are completed, the image data sent from a computer is bit-mapped, or at an interval between feeding sheets.

If the cleaning of the grid electrode 8 is thus carried out at a suitable time interval, the grid electrode 8 is always kept clean, thereby forming a quality image with stability. In particular, if the cleaning process is carried out every time a predetermined time has passed or imaging has been performed on a predetermined number of sheets, i.e., if the frequency of cleaning is increased, it is possible to maintain the quality of image at a high level. Moreover, as mentioned above, if the cleaning of the grid electrode 8 is carried out at a time interval which does not influence the imaging process, for example, during a warm-up period, after completion of a sequence of imaging processes, during bit-mapping of image data, or at an interval between feeding sheets, the operator does not face problems such as a delay of processing.

The cleaning operation will be explained below. When the time at which the cleaning process to be carried out comes, the voltage to be applied to the toner supply roller 72 is switched to positive (the polarity opposite to the toner 76), and the toner supply roller 72 and the toner carrying roller 71 are rotated in this state. The toner 76 on the surface of the toner carrying roller 71 is attracted and moved by a positive electric potential of the toner supply roller 72. Thus, substantially no toner 76 remains on the surface of the toner carrying roller 71. Then, the solenoids 78 are turned on to lower the developing device 7 toward the grid electrode 8 so that the brush section of the toner carrying roller 71 comes into contact with the grid electrode 8. At this time, the toner carrying roller 71 is rotated by coupling with the free joint on the main body 1, and rubs on the grid electrode 8.

At the same time the switching circuit **9*a* of the power source section 9 is switched so as to apply a negative voltage (the same polarity as the toner 76) to the control electrode 8*b* of the grid electrode 8. As a result, the toner 76 on the grid electrode 8 moves to the toner carrying roller 71 due to repulsion against the grid electrode 8, thereby cleaning the grid electrode 8**.

As described above, by applying the voltage of a polarity opposite to the toner 76 to the toner supply roller 72, the toner 76 is removed from the surface of the toner carrying roller 71. Thereafter, cleaning is performed by bringing the toner carrying roller 71 into contact with the grid electrode 8. With this arrangement, it is possible to perform cleaning while preventing the toner 76 on the toner carrying roller 71 from adhering to the grid electrode 8. During cleaning, by applying the voltage having the same polarity as the toner 76 to the control electrode **8*b* of the grid electrode 8, it is possible to efficiently cause the toner 76 adhering to the grid electrode 8 to move to the toner carrying roller 71, thereby improving the cleaning efficiency. In this case, since the toner 76 removed from the grid electrode 8 is held by the brush-like toner carrying roller 71, it is possible to prevent the toner 76 from flying in the main body 1** of the image forming apparatus.

When the cleaning operation is completed, the solenoids 78 are turned off, and the developing device 7 returns to the initial position because of the extension forces of the springs 79.

In the image forming apparatus disclosed by Japanese Publication for Unexamined Patent Application No. 211064/1991 (Tokukaihei 3-211064), a toner carrier provided with a raising member is separably attached to an opening section of a control electrode, and cleaning is performed by bringing the toner carrier into contact with the opening section of the control electrode. With this structure, however, the raising member only scrapes off the toner adhering to the control electrode.

By contrast, with the structure of the present invention, the brush-like conducting toner carrying roller 71 is used. The toner carrying roller 71 is connected to the earth potential, and a negative voltage (the same polarity as that of the toner 76) is applied to the control electrodes **8*b* of the grid electrode 8. Therefore, the toner 76 adhering to the grid electrode 8 is not only mechanically scrapped off by the toner carrying roller 71, but also separated from the grid electrode 8 by Coulomb repulsion against the control electrodes 8*b* and moves to the surface of the toner carrying roller 71 which is in contact with the grid electrode 8. It is thus possible to clean the toner 76 adhering to the grid electrode 8** more efficiently than with the conventional structure.

Moreover, with the structure of the present invention, since the toner carrying roller 71 is connected to the earth potential, even if the surface of the grid electrode 8 is charged by the adhering toner 76, it is possible to remove charges on an insulating surface coating the grid electrode 8. This structure eliminates conventional problems that sharpness of the image deteriorates due to scattering and variations in the shape of dots to be formed because an electric field forming the image is distorted by charges on the surface of the grid electrode 8.

The developing device of the present invention aims for continuous transport of a sufficient amount of toner when non-magnetic toner is used, and aims for the formation of quality images in a stable manner with an inexpensive small-size structure.

When magnetic toner is used, since the toner is carried on the toner carrying roller by magnetic forces, the adhesive force of the toner to the toner carrying roller is small. On the other hand, when non-magnetic toner is used, it is necessary to hold the toner on the toner carrying roller by the adhesive force of the toner. Consequently, the adhesive force of the toner is made stronger. Therefore, when the non-magnetic toner is used, a force which causes the toner to fly from the toner carrying roller to the back electrode becomes smaller. As a result, the flying force of toner may be decreased. Then, in the conventional structure, in order to prevent a decrease in the flying force of toner, for example, it is necessary to increase the applied voltage to the back electrode.

As described above, with the structure of the present invention, since the brush-like toner carrying roller 71 is used and the toner 76 penetrates into gaps of the brush, a sufficient amount of the toner 76 can be held on the roller surface. It is thus not necessary to carry the toner on the roller surface using magnetic forces. Thus, the structure of the present invention can be achieved using non-magnetic toner.

Furthermore, in the structure of the present invention, since the peripheral velocity of the toner carrying roller 71 is set higher than the sheet transport speed, it is possible to cause a sufficient amount of the toner 76 to fly. Namely, since the amount of flying toner 76 is proportional to the peripheral velocity of the toner carrying roller 71, it is possible to increase the amount of the flying toner 76 with an increase in the peripheral velocity of the toner carrying roller 71. Since a decrease of the flying force is thus compensated, even if the non-magnetic toner is used, it is possible to cause a sufficient amount of the toner 76 to fly and form an image of a satisfactory density without increasing the applied voltage to the back electrode 5. Therefore, even when toner whose adhesive force to the toner carrying roller 71 is strong, for example, non-magnetic toner, is used, it is possible to increase the amount of flying toner and form an image of a satisfactory density without raising the applied voltage to the back electrode 5.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A developing device for causing toner to fly and adhere to a recording medium, for forming an image, comprising:

a brush-like toner carrying roller for carrying charged toner, said toner carrying roller having an electric potential equal to a charging potential of said toner or being connected to an earth potential;

a toner supply roller, disposed in contact with said toner carrying roller, for charging said toner by friction;

a back electrode, disposed to face said toner carrying roller, for causing said toner carried on said toner carrying roller to fly by forming an electric field;

a grid electrode, disposed between said toner carrying roller and said back electrode, including a plurality of gates for allowing a passage of said flying toner, and controlling means for controlling an amount of said toner passing through said gates by applying a varying voltage to said gates according to image data to be formed; and voltage applying means for applying a voltage having the same polarity as the charging polarity of said toner to said toner supply roller.

2. The developing device according to claim 1, wherein said toner carrying roller is rotated in a forward direction with respect to a transport direction of said recording medium.

3. The developing device according to claim 1, wherein a rotation speed of said toner carrying roller is set so that a moving speed of a surface of said toner carrying roller is higher than a moving speed of said recording medium.

4. The developing device according to claim 1, wherein said toner is non-magnetic toner.

5. The developing device according to claim 1, further comprising moving means for moving said toner carrying roller to a position where said toner carrying roller comes into contact with said grid electrode, wherein said grid electrode is cleaned by said rotating toner carrying roller.

6. The developing device according to claim 1, wherein a rotation direction of said toner supply roller is equal to a rotation direction of said toner carrying roller.

7. The developing device according to claim 6, wherein a peripheral velocity of said toner supply roller is set higher than a peripheral velocity of said toner carrying roller.

8. The developing device according to claim 1, wherein an resistivity of said toner supply roller is set lower than an resistivity of said toner carrying roller.

9. The developing device according to claim 1, wherein said toner supply roller is a conducting resilient roller including a core member made of a conducting metal roller and a conducting resilient member surrounding said core member.

10. The developing device according to claim 9, wherein said resilient member is formed by coating a surface of an urethane resin foam with conducting urethane rubber.

11. The developing device according to claim 1, wherein said toner carrying roller has a conducting property.

12. The developing device according to claim 11, wherein said toner carrying roller includes a conducting core member and a conducting brush section.

13. The developing device according to claim 12, wherein said brush section includes a conducting sheet-type material, and conducting fibers implanted in said sheet-type material.

14. The developing device according to claim 13, wherein said conducting fibers are formed by mixing carbon black into rayon fibers.

15. The developing device according to claim 12, wherein said brush section includes a conducting sheet-type material and a fuzzy cloth including conducting fibers.

16. The developing device according to claim 12, wherein said brush section includes a conducting resin film with an uneven surface formed on said core member.

17. The developing device according to claim 4, wherein said moving means moves said toner carrying roller to a position where said toner carrying roller comes into contact with said grid electrode in a warm-up period immediately after turning on a power source of said image forming apparatus.

18. The developing device according to claim 4, wherein said moving means moves said toner carrying roller to a position where said toner carrying roller comes into contact with said grid electrode at predetermined time intervals during imaging.

19. The developing device according to claim 4, wherein said moving means moves said toner carrying roller to a position where said toner carrying roller comes into contact with said grid electrode every time imaging has been performed on a predetermined number of sheets of said recording medium.

20. The developing device according to claim 4, wherein said moving means moves said toner carrying roller to a position where said toner carrying roller comes into contact with said grid electrode during bit-mapping of the image data.

21. The developing device according to claim 4, wherein said moving means moves said toner carrying roller to a position where said toner carrying roller comes into contact with said grid electrode at an interval between feeding of said recording medium.

22. The developing device according to claim 4, further comprising polarization switching means for switching a voltage generated by said voltage applying means to a voltage whose polarity is opposite to the charging polarity of said toner during cleaning.

23. The developing device according to claim 4, wherein said grid electrode is connected to an electric potential which has the same polarity as the charging polarity of said toner during cleaning.

* * * * *